United States Patent [19]

Young

[11] Patent Number: 4,946,407

[45] Date of Patent: Aug. 7, 1990

[54] HIGH CURRENT CONNECTORS AND METHODS OF ASSEMBLY

[75] Inventor: Thomas A. Young, Barboursville, W. Va.

[73] Assignee: OB Products, Inc., Mansfield, Ohio

[21] Appl. No.: 255,481

[22] Filed: Oct. 11, 1988

[51] Int. Cl.[5] ..... H01R 13/502

[52] U.S. Cl. ..... 439/686; 439/744; 439/819; 29/857

[58] Field of Search ..... 439/249, 250, 251, 252, 439/819, 820, 821, 823, 465, 470, 471, 472, 744, 871, 686, 695; 29/857

[56] References Cited

U.S. PATENT DOCUMENTS

| | | | |
|---|---|---|---|
| 2,303,425 | 12/1942 | Bickham | 439/251 |
| 3,052,867 | 9/1962 | Rogoff | 439/823 X |
| 3,884,541 | 5/1975 | O'Nan et al. | 439/822 |
| 4,422,706 | 12/1983 | Neuhouser | 439/465 |
| 4,776,816 | 10/1988 | Herscovici et al. | 439/871 X |

*Primary Examiner*—Neil Abrams
*Assistant Examiner*—Khiem Nguyen
*Attorney, Agent, or Firm*—Walter G. Marple, Jr.; Nicholas L. Coch; John E. Kidd

[57] ABSTRACT

A high current carrying connector plug and receptacle are disclosed. The plug comprises a body of electrical insulating material with plurality of shaped passages extending therethrough, electrical conductors having a flat blade contact portion, a stop means and a hollowed cylindrical portion for receiving and securing a current carrying electrical cable. The passages include stop engaging means. A retainer means engages the flat bladed portion preventing axial movement of the conductors in the plug body.

The receptacle comprises a body of electrical insulating material having shaped passages therethrough, electrically conductive conductor contact engaging assemblies in each passage at the front face of the body. The contact assemblies comprise movable jaws having a front contact engaging portion and a rear coupler engaging portion and a spring retainer means converging at least one pair of jaws. The electrical conductors have a coupler portion, stop means and a cylindrical body portion with a recess for receiving high current carrying electrical cable. Each of the passages are shaped to include stop engaging means to "stop" the conductors and retain them against the stop means. Movement of the conductor contact engaging assembly and the conductors along an axis from the front face to the rear face is prevented by the retainer means.

14 Claims, 8 Drawing Sheets

HIGH CURRENT CONNECTORS AND METHODS OF ASSEMBLY

BACKGROUND OF THE INVENTION

1. Field of the Invention

This invention relates to improved high current connector structures and a method of assembling such improved connector structures.

2. Description of Related Art

Connectors of the general type to which the present invention relates are shown in U.S. Pat. Nos. 2,542,404, to Ensign, and 3,984,169, to Armstrong et al. As with many connectors, this connector has two halves, a plug half and a receptacle half, each including a body of insulating material and conductive elements of some kind extending through the bodies of material.

The high-current type of connector differs from others in requiring relatively massive conductive components because of the currents which must be handled by those components. Furthermore, the conductive components are preferably formed so that there is no necessity to make multiple connections within each connector half. Accordingly, it has become known to form the body of insulating material in each conductor half with passages extending therethrough, the passages receiving the conductive elements which are either molded into the body or are installed therein after the body has been molded. In the latter case, the conductive elements have heretofore been assembled from the face end of the connector body as shown for example in U.S. Pat. No. 4,422,706 to Neuhouser Nuhouser. Then, at the time of use, to the rear ends of the conductive elements using screw terminals or the like, the front ends of the conductive elements being exposed toward each other at the front faces of the bodies for interconnection when the plug and receptacle components are joined.

The techniques used to form connectors of this type have proven to be rather expensive and not always satisfactory in so far as the electrical characteristics of the connections are concerned.

SUMMARY OF THE INVENTION

Accordingly, an object of the present invention is to provide high-current connector structures in which the electrically conductive components are improved so as to be less expensive to manufacture and use.

A further object is to provide such connector structures having improved mechanical and electrical characteristics.

Briefly described, the present invention comprises high-current connectors including a separate mateable male plug portion and female receptacle portion. The male plug portion has a first body of electrical insulating material having a front face and a rear face and a plurality of unitary blade members extending through the first body with a generally flat conductor contact end at the front face for engaging a mating conductive member. The blade members are attached to an electrical cable by crimping or the like and are inserted through the rear face of said body and retained by a spring clip means. The receptacle portion has a second body of electrical insulating material with a front face and a rear face and a plurality of passages extending entirely through the body between those faces. A plurality of electrically conductive conductor contact-engaging assemblies occupy the front of the passages with means at the front face of the second body for engaging a flat end of one of the conductor contact blade members of a male plug portion. Each of the receptacle assemblies includes at least one pair of independently formed and movable jaws each having front and rear portions and retainer means for enclosing and holding the pair of jaws with the front contact engaging portion of the jaws adjacent the front face of the second body in position to receive a flat end of one of the conductor contact blade members. The retainer includes spring means for urging the jaws toward each other. Each receptacle assembly also includes a substantially solid electrically conductive bar inserted through the rear of the connector body and extending through a passage in the connector body. The bar having means defining a generally T-shaped coupler at the front end thereof and a tubular rear end portion which can be crimped to an electrical cable, the T-shaped coupler being removably insertable between the rear coupler portion of the jaws which makes possible the assembly of the connector after attachment to the cable.

BRIEF DESCRIPTION OF THE DRAWINGS

In order to impart full understanding of the manner in which these and other objects are attained in accordance with the invention, a particularly advantageous embodiment thereof will be described with reference to the accompanying drawings, which form a part of this specification, and wherein:

FIG. 9C is a vertical cross-sectional view of FIG. 9B.

DESCRIPTION OF A PREFERRED EMBODIMENT

Figure 1:
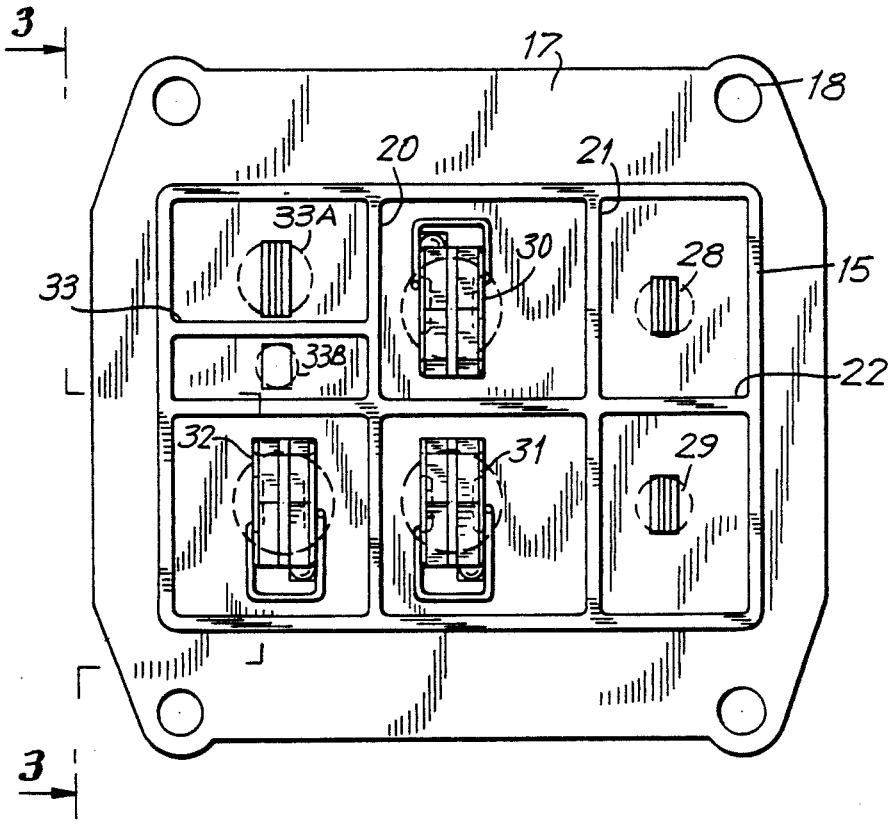
FIG. 1 is a front elevation of a male plug portion of a connector in accordance with the present invention.
Figure 2:
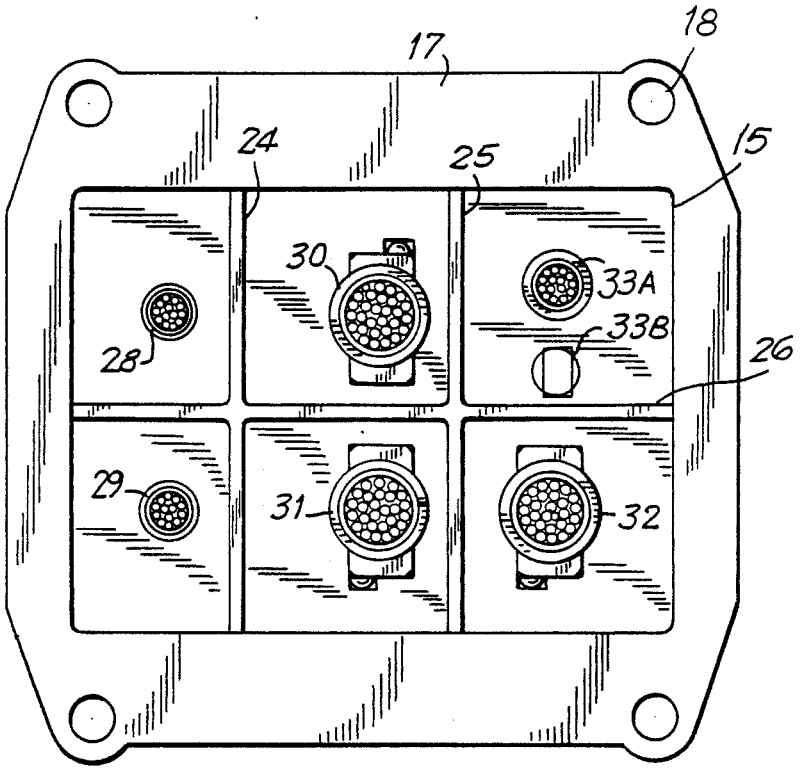
FIG. 2 is a rear end elevation of the male plug portion of FIG. 1.

Referring first to FIGS. 1 and 2, the plug portion of the illustrated embodiment of a connector in accordance with the invention includes a body indicated generally at 15 of electrically non-conductive, moldable material which is unitarily formed with a flange 17 having mounting holes 18. The body and flange can be attached to a mounting arrangement permitting the plug and receptacle to be hingedly attached to each other as shown generally in U.S. Pat. Nos. 2,542,404 and 3,984,169. However, this aspect of the apparatus forms no part of the present invention and will not be further described. The front face of body 15, shown in FIG. 1, is divided into six major cells by a plurality of perpendicular walls 20, 21 and 22. Within each cell is a shaped passage which extends entirely through the body 15 and emerges at the rear face which is similarly divided into a plurality of cells by walls 24, 25 and 26. Each passage is shaped to receive a particular conductor contact blade member, the blade members being shaped and dimensioned differently for different purposes and to carry different levels of currents. In FIGS. 1 and 2, passages 28 and 29 are shown with pilot type blades while three other passages contain high current blade members 30, 31 and 32. The remaining cell is further divided by wall 33 and has case ground 33B and ground type 33A conductor contact blade members 42. This allows a case ground pin to be added while maintaining compatibility with other units in which the cell divided by wall 33 is a cavity with a single ground pin.

Figure 3:
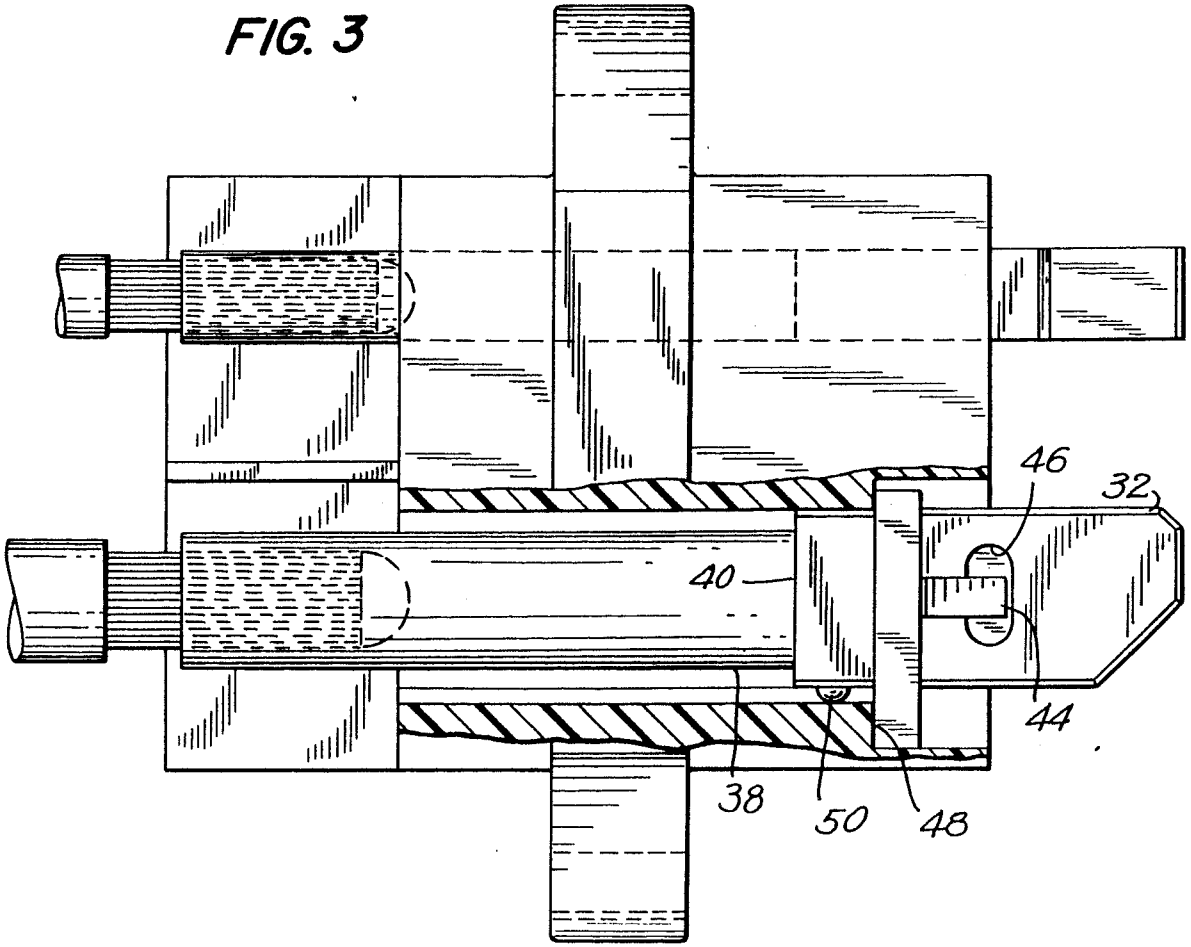
FIG. 3 is a partial side elevation in section along line 3—3 of FIG. 1 showing a blade member within the male connector body.
Figure 4A:
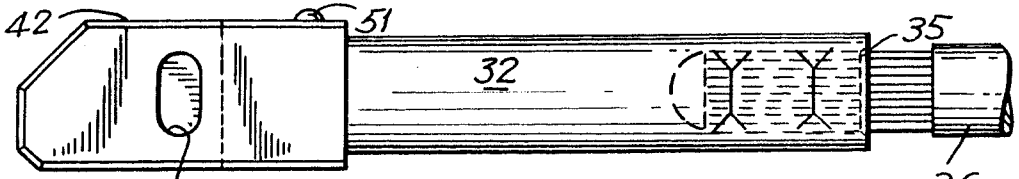
FIG. 4A is a side view of a high current carrying blade member apart from the male plug connector body.
Figure 4B:
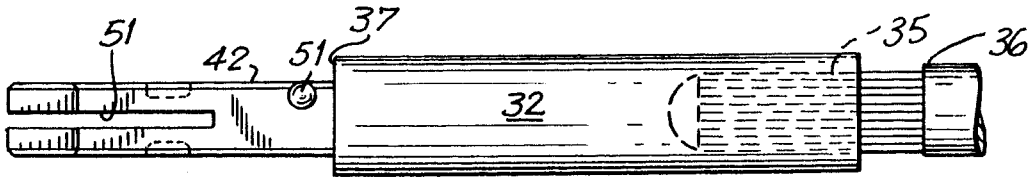
FIG. 4B is a top view of the high current carrying blade member shown in FIG. 4A.

Conductor contact blade member 32 is best seen in FIGS. 3, 4A and 4B and will be described as a typical example of such a blade structure.

As seen in FIGS. 4A and 4B, the body of the conductor contact blade member 32 is a generally cylindrical, elongated metal member, preferably copper, having a cylindrical recess 35 at the rear end thereof, making the rear end into a relatively thin-walled tube so that the stripped end of a electrical cable 36 can be inserted therein and the tubular end can be crimped to form a good electrical and mechanical connection with the cable.

As shown in FIG. 4B the cylindrical body portion of a conductor contact blade member such as 32 terminates in the generally rectangular parallelpiped contact portion 42 creating a shoulder 37 which acts as a stop transition which is stopped at the stop engaging end 40 of shaped passage 38 in connector body 15 as shown in FIG. 3. The shoulder 37 limits the axial movement of the conductor in the direction towards the connector face, movement in the opposite direction is prevented by a spring clip 44 engaging slot 46 and wall 48. The blade member 32 is provided with a protrusion 50 which insures proper orientation of the blade when the connector is assembled.

While many variations on the shapes and other characteristics of the conductor contact blade members are possible, some important basic features should be emphasized. First, it will be observed that the conductor contact blade member is provided with a crimp connection so that the cable can be inserted into the recess 35 of the blade member and attached thereto before the conductor contact blade member is inserted into body 15. This permits the attachment of the cable by a technique which forms a particularly good mechanical and electrical connection between these parts. Then, after the cable has been attached, the conductor contact blade member is inserted from the rear face towards the front face in the orientation dictated by protrusion 50 through the shaped passage provided therefor in body 15 and clip 44 is slipped onto the protruding portion of the blade within the cell, retaining the blade in its installed position. The passage beyond stop 40 is shaped to enclose blade portion 42 which prevents rotation of the conductor contact blade member. Thus, the blade is constrained against movement in all directions, although some "lost motion" movement can be permitted to allow the blade to accommodate itself to a mating conductive female receptacle member.

Figure 5:
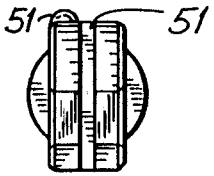
FIG. 5 is a front end view of the current carrying blade member of FIG. 4.
Figure 6:
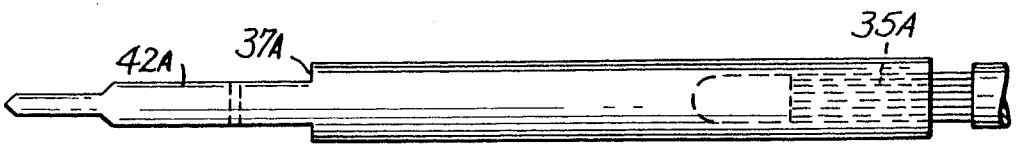
FIG. 6 is a side view of a ground or pilot blade member apart from the male plug connector body.

The current carrying conductor contact blade member 32 is shown in FIGS. 4B and 5 with a slot 51 that permits interconnection of the plug portion of the connector of the invention with receptacle portions other than those of the invention allowing a wide range of interconnectability for cables utilizing the invention. Such interconnectability is further enhanced by the use of pilot conductor contact blade members and ground contact blade members such as those shown generally in FIG. 6. Ground and pilot conductor contact blade members 28, 29, 33A and 33B are of generally smaller dimensions than high current carrying conductor contact blade members 30, 31, 32. They are nevertheless configured similarly to blade members 32 having a flat contact portion 42A which transitions to a cylindrical body portion with a recess 35A for receiving and securing an electrical cable. These blade members are also installed from the rear after being secured to a cable and are retained into the body 15 by a clip and slot or by a pin through a hole in the flat blade portion. The conductor contact blade members are arranged as shown in FIG. 1 which is a standard connector arrangement utilized in the mining industry, for example. The connector configuration of the invention which permits a wide range of conductor contact blade member designs is equally adaptable to the high current cabling of other industries as well.

Figure 7:
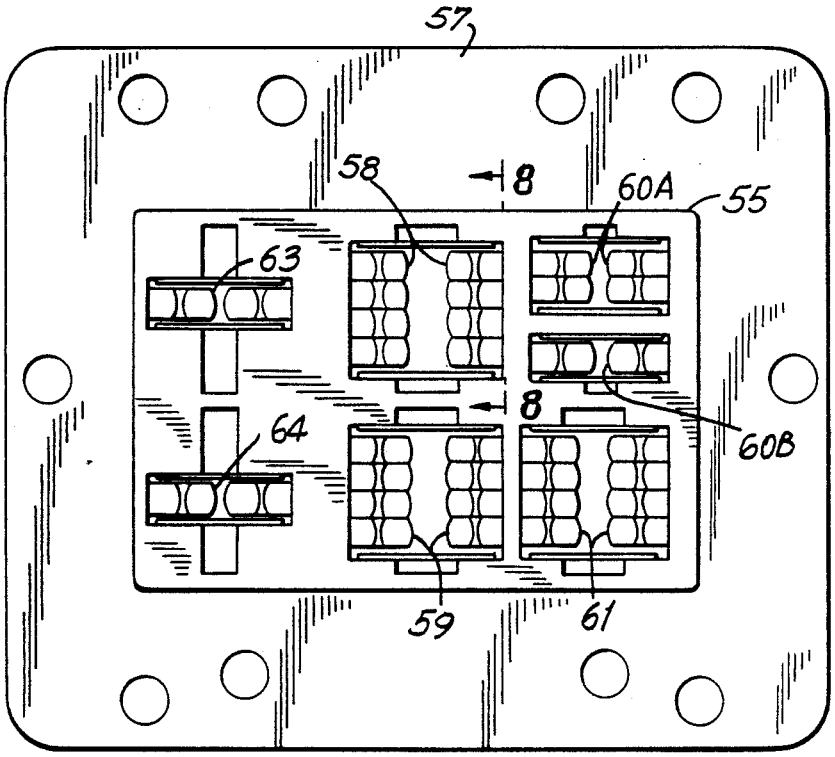
FIG. 7 is a front elevation of a receptacle portion of a connector in accordance with the present invention.

FIGS. 7–10 show the receptacle portion of a connector usable with the plug portion described above and plug portions of connectors currently used in high current cabling such as that used in the mining industry, for example. As shown in FIG. 7, the receptacle also includes a body 55 of electrically non-conductive material having a flange 57 extending outwardly therefrom. In a preferred form of the invention, the receptacle portion includes a structure of movable jaws to receive the conductor contact blades of a plug portion, the receptacle shown in FIG. 7 having sets of jaws 58 to receive blade 30, sets of jaws 59 to receive blade 31 and set of jaws 61 to receive blade 32. Additionally, sets of jaws 63, 64, 60A and 60B are provided to receive the pilot and ground type conductor contact blades inserted into openings 28, 29, 33A and 33B respectively of plug portion 15.

The various sets of jaws shown in FIG. 7 are substantially identical in their construction, the difference being the number of pairs of jaws which are included in each set. Thus, jaw sets 60B, 63 and 64 include one pair of jaws while jaw set 60A includes two pairs and jaw sets 58, 59 and 61 include four pairs each. While there is no difference in principle, the larger number of jaw pairs will accommodate a larger conductor contact blade and can carry a concomitantly larger amount of current.

Figure 8:
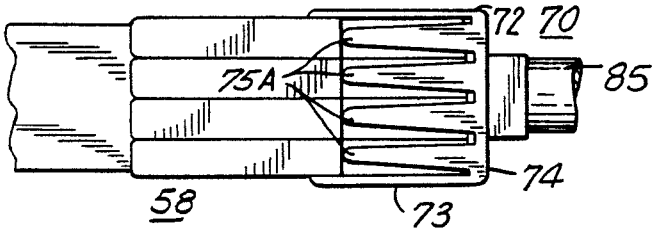
FIG. 8 is a partial side elevation, in section, along line 8—8 of FIG. 7 showing a conductor contact-engaging assembly in the receptacle.
Figure 9A:
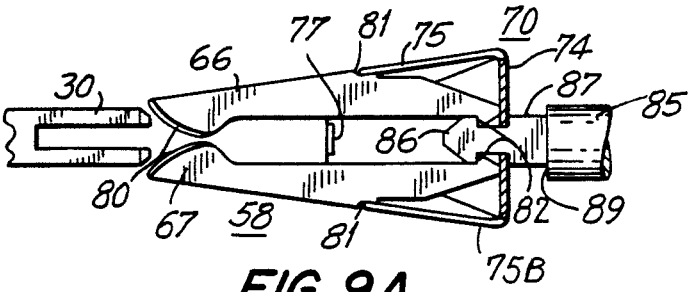
FIG. 9A is a top plan view of the conductor contact-engaging assembly of FIG. 8 showing conductor-blade retainer apart from the insulating body.
Figure 10:
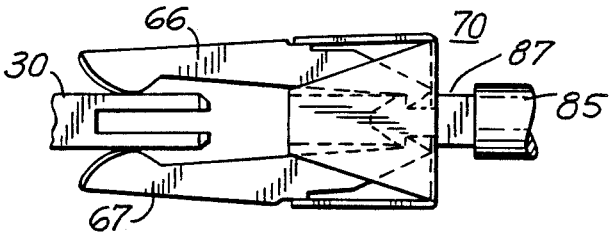
FIG. 10 is an enlarged partial top plan of the blade-engaging assembly of FIG. 8 with a conductor contact blade inserted.

FIGS. 8 and 9A and 10 show one of the jaw sets 58, 59 and 61 in somewhat greater detail and further illustrate the manner of conducting current to and away from the jaw set. The jaw sets 63, 64, 60A and 60B are constructed identically differing only in the number of pairs making up the set.

As shown in these figures, the jaw set includes pair of jaws 66 and 67 which are independently formed and are independently movable, their position and movement being constrained and determined by the members to which they are connected. Each jaw set is housed within a retainer 70 which has end walls 72 and 73 and a rear wall 74. The retainer 70 is made of a sheet metal material such as steel having a suitable degree of resilience. A plurality of upper and lower spring fingers 75A and 75B protrude forwardly and inwardly from rear wall 74 to retain the jaws therebetween. End walls 72, 73 terminate in inwardly bent fingers 77 which lie between jaws 66 and 67 and similarly limit their motion.

As best seen in FIG. 9A, each jaw pair 66, 67 has a forward end conductor contact engaging portion 80 which is tapered and chamfered so that a conductor contact blade member such as blade 30, when pushed against the end of the jaws, forces the jaws apart. Each jaw is also formed with a notch indicated generally at 81 to receive the distal end of a spring finger 75. On the inner surface, each jaw is also formed with a coupling notch 82.

Each female receptacle portion includes a conductor contact engaging assembly with a jaw structure such as that described and also an electrical conductor 85 having a generally T-shaped forward end coupler portion 86 and a recess 90 at the rear end thereof to form a crimp connection with stripped end of a cable in the same fashion as shown for the male conductor contact blade members. The T end of conductor 85 is shaped and dimensioned to pass through an opening in end wall 74 of the retainer 70 and to pass between the rear ends of jaws 66 and 67. The ends of the coupling T member 86 engage coupling notches 82 in the jaws and, when thus inserted, resist removal from the retainer. Removal is possible, however, so long as no blade is inserted between ends 80 of the jaws, by relieving some of the spring pressure of spring fingers 75 and disengaging notch 82 from the coupling T end of the conductor.

Figure 9B:
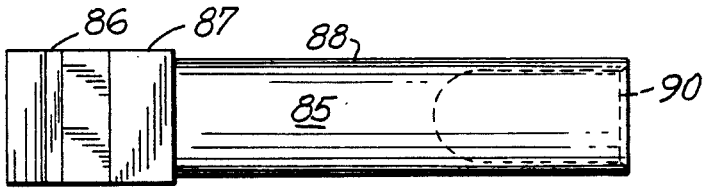
FIG. 9B is a side elevational view of a high current carrying member apart from contact engaging assembly.

As illustrated in FIGS. 8, 9A, and 9B, the portion of conductor 85 at the forward end thereof, leading to the T-shaped head 86, is a solid, flat and rectangular portion 87, this shape transitions to a cylindrical rear body portion 88 forming a stop engaging shoulder 89 and ends with recess 90. This shape is particularly suitable for a relatively wide conductor such as that shown. Narrower members similarly configured will, of course, be employed with jaw sets such as 63 and 64 which have only one pair of jaws. Other variations in shape will be apparent, but it will again be recognized that there are certain characteristics which make the assembly particularly effective. First, the jaw sets and retainer associated therewith can be inserted into the front of the shaped passage provided for that purpose in body 55. A cable can be connected to conductor 85, apart from the remainder of the assembly, by inserting the stripped end of the cable into recess 90 and compressing the walls with a suitable, conventional crimping tool. The coupling end 86 of conductor 85 can then be inserted through a shaped passage in the insulating material from the rear face towards the front face of the body 55, omitted from FIGS. 8 and 9A for simplicity, and through the rear of the retainer 70, against a stop in the passage and into its coupled position between the pairs of jaws. Thus the entire assembly is prevented from axial movement when a male plug connector is mated with the female receptacle so assembled. The passage is also shaped to enclose the flat portion of conductor 85 to prevent rotation in a manner similar to that described above for the plug portion 15.

At this point, the jaw pairs are relatively loose and the jaws are independently movable. However, when a blade is inserted between the jaws, as shown in FIG. 10, the jaws are forced outwardly against the force of spring fingers 75 which are thus under considerable tension. A lever-like relationship is thus formed in which blade 30 forces the jaw ends outwardly and the end of spring fingers 75 urge the intermediate portions of the jaws inwardly while the rear ends of the jaws pivot about fulcrums formed by notches 82 and the outer end of head 86, forming a coupled arrangement similar to a third class lever.

Figure 11:
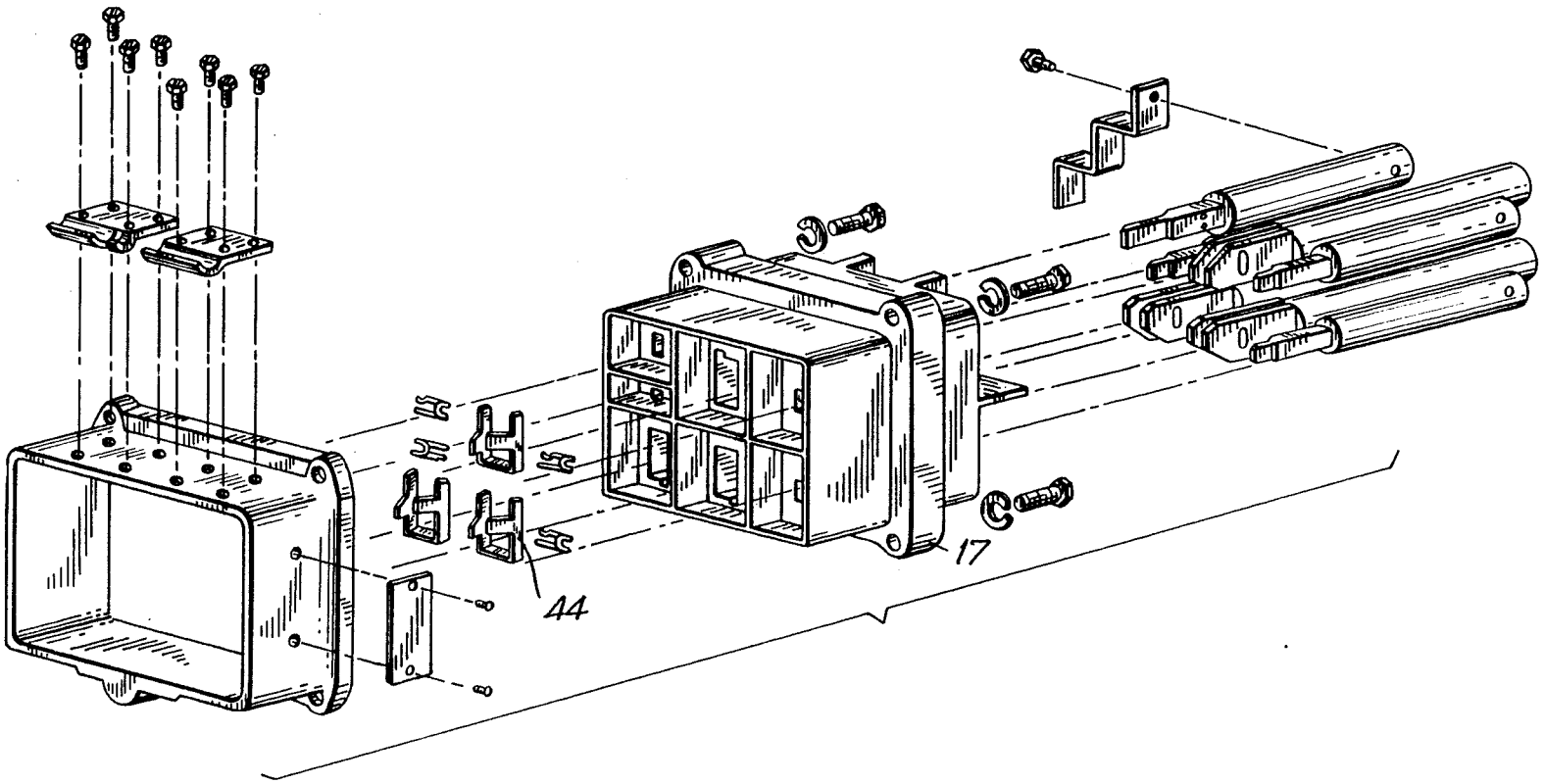
FIG. 11 is an assembly drawing of the preferred embodiment of the male plug portion of the connector of the invention.
Figure 12:
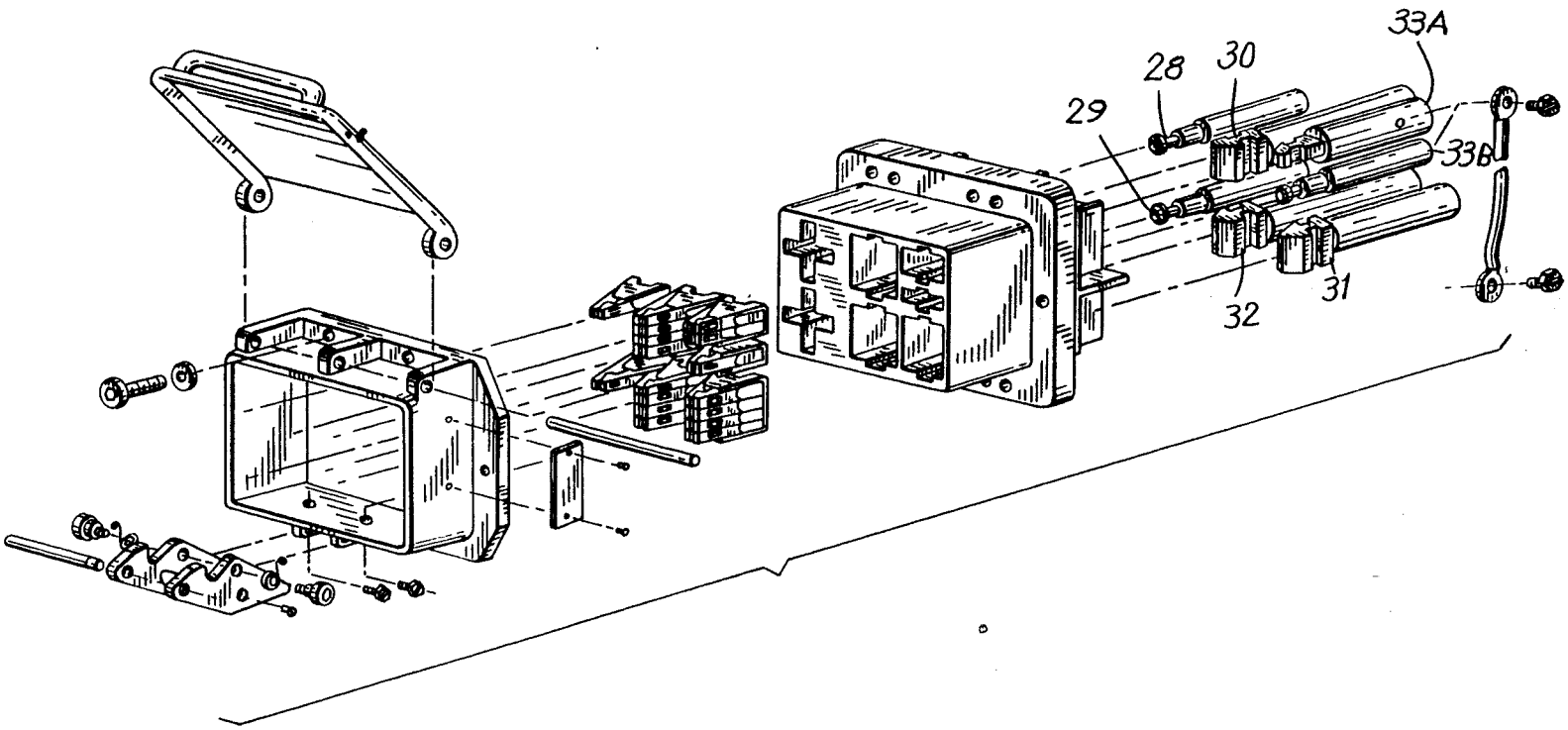
FIG. 12 is an assembly drawing of the preferred embodiment of the female receptacle portion of the connector of the invention.

FIGS. 11 and 12 clearly illustrate how a plug portion and a receptacle portion of the connector of the invention are assembled in the manner described herein.

While one advantageous embodiment has been chosen to illustrate the invention, it will be understood by those skilled in the art that various changes and modifications can be made therein without departing from the scope of the invention as defined in the appended claims.

What is claimed is:

1. A high current carrying connector plug comprising:

(a) A body of electrical insulating material having a front face, a rear face and a plurality of shaped passages extending from said rear face to said front face;

(b) a plurality of electrical conductors having a flat bladed contact portion, a stop means portion and a cylindrical body portion with a recess formed therein for receiving and securing a current carrying electrical cable;

(c) each of said passages shaped to include stop engaging means for engaging said stop means, such that said conductors inserted in said passages from said rear face toward said front face are stopped with the flat bladed contact portion extending for mating engagement; and (d) retainer means engaging said flat bladed portion for retaining said conductors within said body of electrical insulating material against said stop engaging means whereby axial movement of said conductors, along an axis from said front face to said rear face, is prevented.

2. The connector plug of claim 1 wherein said passages are shaped to engage said flat bladed portion of said conductors and prevent rotation thereof.

3. A high current carrying connector receptacle comprising:

(a) a body of electrical insulating material having a front face, a rear face and a plurality of shaped passages extending from said rear face to said front face;

(b) a plurality of electrically conductive conductor contact engaging assemblies in each of said plurality of shaped passages at the front face of said body;

(c) each said conductor contact engaging assembly further comprising:

(i) at least one pair of independently formed and independently moveable jaws having a front contact engaging portion and a rear coupler engaging portion; and (ii) retainer means, including spring means, for enclosing, holding and urging toward each other said at least one pair of jaws with said front contact engaging portion thereof adjacent said front face for retaining said conductors;

(d) A plurality of electrical conductors having a coupler portion, stop means and a cylindrical body portion with a recess formed therein for receiving and securing a high current carrying electrical cable;

(e) each of said passages shaped to include stop engaging means for engaging said stop means such that said electrical conductors inserted in said passages from said rear face toward said front face are stopped by said stop engaging means; and (f) said rear coupler engaging portions being adapted to engage said coupler portions whereby said electrical conductors are retained against said stop means and movement of said conductor contact engaging assembly and said conductors, along an axis from said front face to said rear face, is prevented.

4. The receptacle of claim 3 wherein said passages are shaped to engage said flat portion of said conductors and prevent rotation thereof.

5. A method of assembling a high current carrying connector plug comprising the steps of:

(a) securing at least one high current carrying cable in a recess formed in the cylindrical body portion of at least one electrical conductor having a flat bladed contact portion, stop means and a cylindrical body portion;

(b) inserting said electrical conductor into one of a plurality of shaped passages, including stop engaging means therein for engaging said stop means in a connector body of electrical insulating material, having a front face and a rear face, from the direction of the rear face towards the front face until said conductor is stopped by said stop engaging means; and (c) securing said electrical conductor against said stop means with retainer means whereby movement of said electrical conductor, along an axis from said front face to said rear face, is prevented.

6. The method of claim 5 further comprising the steps of:

(a) securing at least one low current carrying cable in a recess formed in the cylindrical body portion of another electrical conductor having a flat bladed contact portion, stop means and a cylindrical body portion;

(b) inserting said another electrical conductor into one of said plurality of shaped passages including stop engaging means, from the direction of said rear face towards said front face, until said another electrical conductor is stopped by said stop engaging means; and (c) securing said another electrical conductor against said stop engaging means with retainer means whereby movement of said another electrical conductor, along an axis from said front face to said rear face, is prevented.

7. A method of assembling high current carrying connector receptacle comprising the steps of:

(a) securing at least one high current carrying cable in a recess in the cylindrical body portion of at least one electrical conductor having a coupler portion, stop means and a cylindrical body portion;

(b) inserting, at the front face, at least one electrically conductive contact engaging assembly in one of a plurality of shaped passages, including stop engaging means therein for engaging said stop means in a body of electrical insulating material, having a front face and a rear face;

(c) said electrically conductive contact engaging assembly comprising:

(i) at least one pair of independently formed and independently movable jaws having a front contact engaging portion and a rear coupler engaging portion; and (ii) retainer means, including spring means for retaining said conductors and for enclosing, hold and urging toward each other said at least one pair of jaws with said contact engaging front portion thereof adjacent said front face;

(d) inserting said electrical conductor into said one of a plurality of shaped passages from the direction of said rear face towards said front face until said electrical conductor is stopped by said stop engaging means and said coupler portion is engaged by said rear couple engaging portion of said at least one pair of jaws to retain said electrical conductor against said stop means whereby movement of said conductor contact engaging assembly and electrical conductor, along an axis from said front face to said rear face, is prevented.

8. The method of claim 7 further comprising the steps of:

(a) securing at least one low current carrying cable in a recess in the cylindrical body portion of another electrical conductor having a coupler portion, stop means and a cylindrical body portion;

(b) inserting, at the front face, another electrically conductive contact engaging assembly in another one of said plurality of shaped passages including stop means therein;

(c) inserting said another electrical conductor into said another one of said plurality of shaped passages from the direction of said rear face towards said front face until said another electrical conductor is stopped by said stop engaging means and said coupler portion is coupled to said rear couple engaging portion of said another electrically conductive contact engaging assembly to retain said another electrical conductor against said stop means.

9. The connector plug of claims 1 or 2 wherein at least one of said plurality of electrical conductors is a low current carrying conductor.

10. The connector plug of claims 1 or 2 wherein at least one of said plurality of electrical conductors is a ground conductor.

11. The connector plug of claims 1 or 2 wherein at least one of said plurality of electrically conductors is a pilot pin.

12. The connector receptacle of claims 3 or 4 wherein at least one of said plurality of conductor contact engaging assemblies is coupled to one of said plurality of electrical conductors which is secured to a low current carrying cable.

13. The connector receptacle of claims 3 or 4 wherein at least one of said plurality of conductor contact engaging assemblies is coupled to one of said plurality of electrical conductors which is secured to a ground cable.

14. The connector receptacle of claims 3 or 4 wherein at least one of said plurality of conductor contact engaging assemblies is coupled to one of said plurality of electrical conductors and adapted to engage a pilot pin.

* * * * *